United States Patent [19]

Brackmann et al.

[11] 4,456,018

[45] Jun. 26, 1984

[54] FEEDING TOBACCO CUTTING MACHINES

[75] Inventors: Warren A. Brackmann; Stanislav M. Snaidr, both of Mississauga, Canada

[73] Assignee: Rothmans of Pall Mall Canada Limited, Don Mills, Canada

[21] Appl. No.: 381,213

[22] Filed: May 24, 1982

Related U.S. Application Data

[63] Continuation-in-part of Ser. No. 215,006, Dec. 10, 1980, Pat. No. 4,369,797.

[51] Int. Cl.[3] ..... A24B 3/00; A24B 7/08; A24B 7/12

[52] U.S. Cl. ..... 131/116; 131/117

[58] Field of Search ..... 171/116, 117

[56] References Cited

U.S. PATENT DOCUMENTS

| | | | |
|---|---|---|---|
| 2,897,956 | 8/1959 | Damond | 198/771 |
| 4,149,547 | 4/1979 | Komossa et al. | 131/109 AB |
| 4,244,382 | 1/1981 | Thiele et al. | 131/109 AB |
| 4,254,781 | 3/1981 | Thiele et al. | 131/109 AB |

*Primary Examiner*—V. Millin

*Attorney, Agent, or Firm*—Sim & McBurney

[57] ABSTRACT

The transportation of a tobacco layer, in which the tobacco lamina or leaves are horizontally oriented, on a vertically-reciprocating conveyor surface to a cutting machine wherein tobacco shreds are formed from the tobacco in the layer is assisted, so that the orientation and juxtaposition of the tobacco in the layer is maintained to the cutting machine.

12 Claims, 3 Drawing Figures

FEEDING TOBACCO CUTTING MACHINES

REFERENCE TO RELATED APPLICATION

This application is a continuation-in-part of copending U.S. patent application Ser. No. 215,006 filed Dec. 10, 1980 now U.S. Pat. No. 4,369,797.

FIELD OF INVENTION

The present invention is directed to the feed of tobacco to cutting machines.

BACKGROUND TO THE INVENTION

A known type of tobacco shredding apparatus comprises a rotary carrier for one or more knives which cut tobacco shreds, for use in making cigarettes, from the leading face of a continuous mass of compacted tobacco. The compacted mass is formed and the tobacco therein provided in compacted form by a feeding device comprising a pair of upper and lower feed conveyors which define a gradually narrowing or converging path extending from a source of threshed tobacco lamina to a comminuting station where the leading face of the compacted mass is squeezed between air cylinder pressure assisted upper and lower pressure applying elements and moves into the range of the orbiting knives.

In our prior U.S. patent application Ser. No. 215,006 filed Dec. 10, 1980 now U.S. Pat. No. 4,369,797 assigned to the assignee herein and the disclosure of which is incorporated herein by reference, there is described an improved procedure for feeding tobacco to the compacting pair of upper and lower feed conveyors. As set forth therein, a layer of tobacco first is formed wherein the tobacco is oriented substantially planarly of the layer, the tobacco is interleaved and the tobacco is substantially uniformly distributed across the layer. The tobacco layer then is densified and the leaves nested by applying gravitational and vibrational forces thereto while simultaneously conveying the tobacco towards the upstream end of the converging conveyors without substantially altering the orientation and juxtaposition of the tobacco in the layer. The densified layer then is fed onto the lower one of the converging conveyors without substantially altering the orientation and juxtaposition of the tobacco in the densified layer. In this way, the orientation and juxtaposition of the tobacco is maintained all the way from the initial formation of the layer to the cutters.

The formation and conveying of the tobacco in this manner to the compacting conveyors results in much less compaction being required to be effected on the tobacco layer for the same throughput of tobacco when compared with conventional systems, and much less pressure needs to be applied to the compacted tobacco presented to the cutter to prevent lamina pull-outs, when compared with conventional procedures.

Since less compacting force needs to be applied to the lamina by the conveyors and such compacting force impares the filling power of the cut tobacco, the gravity-induced precompaction and nesting which is effected in this invention preserves the filling power of the cut tobacco. In addition, since the gravity-compacted tobacco is subjected to physical force for a lesser period of time than is usual in the prior art, more of the filling power is preserved.

In one embodiment of the procedure described in our prior application, a vibrating translating conveyor is provided which extends substantially horizontally away from the upstream end of the compacting conveyors. A relatively thick layer of tobacco containing the quantity of tobacco desired to be fed to the cutting station is formed at the upstream end of the conveyor by showering tobacco, in the form of whole leaves or threshed lamina, uniformly over a length of the conveyor, so that the tobacco builds up to the required layer thickness in the longitudinal direction of movement of the conveyor. The tobacco in the relatively thick layer is oriented substantially planarly of the layer and is substantially evenly distributed across the width of the layer.

The tobacco layer is subjected to vibration on the conveyor by vertical reciprocation of the conveying surface as the layer is conveyed thereon by the conveyor towards to the compacting conveyors under the influence of the translating surface of the conveyor. The vibration causes the tobacco in the layer to densify without the use of any force other than gravity while the layer is transported by the translating conveyor towards the cutting station without substantially altering the orientation and juxtaposition of the tobacco in the layer.

This orientation and juxtaposition is maintained as the layer is transferred from the vibrating conveyor to the lower one of the converging conveyors. There is no change in speed of the tobacco from the initial formation of the tobacco layer all the way to the cutters, and hence there is no opportunity for the tobacco to change its orientation and juxtaposition.

This operation contrasts markedly with that set forth in U.S. Pat. Nos. 4,244,382 and 4,254,781, both to Thiele et al, wherein a stepped conveyor is used and the stepped conveyor is vibrated in two directions. The stepped form of the conveyor means that the speed of the tobacco particles abruptly changes as an initially-formed thin layer forms a thick layer at the step in the conveyor for feed to the compacting conveyors. In this prior art, the thick layer of tobacco particles required to be fed to the cutters is formed by tumbling of particles from the thin stream at the step to form the thick layer, thereby altering the orientation and juxtaposition of the particles. The conveyors set forth in this prior art are designed to handle stem material, wherein such manipulation may be tolerated. In the procedure of our prior application, a thick layer is formed from a shower of tobacco lamina or whole leaves wherein the tobacco particles are provided in their final orientation and juxtaposition.

SUMMARY OF THE INVENTION

The present invention is concerned with improvements in the procedure of our prior application to improve the operation thereof. In one aspect, the translational vibrating conveyor is provided with side walls which engage the sides of the tobacco layer and which have translational motion at the same speed as the translational motion of the vibrating conveyor. The provision of these moving side walls avoids any tendency of the tobacco to be held by a stationary side wall, and thereby alter the orientation and/or juxtaposition of the tobacco.

In another aspect of the invention, the magnitude of the vertically-reciprocating vibrations to which the tobacco layer is subjected varies uniformly from a maximum value at the upstream end of the conveying surface to a minimum value at the downstream end of the conveying surface. In this way, the tobacco is subjected to the greatest forces when most needed, that is, during the initial compaction and nesting of the tobacco, and is subjected to a diminishing force as the tobacco compacts to finally-compacted state.

In a preferred embodiment of this aspect of this invention, the conveying surface is pivoted at its downstream end to a horizontal fixed pivot, whereby the vibrational forces are zero at the downstream end.

In a further aspect of the invention, the thick layer of tobacco is formed at the upstream end of the vibrating conveyor by showering the tobacco from above, distributing the tobacco uniformly over a length of the vibrating conveyor to provide an upwardly-sloping rear face to the layer in the downstream direction thereof, and feeding tobacco to the shower in sufficient quantity such that the angle of the upwardly-induced rear surface approximates but does not exceed the angle of repose of the tobacco layer, so that the showered and distributed tobacco lie planarly in the layer and do not tumble or fall from the rear surface of the layer while the thickness of the layer approximates the maximum attainable in the shortest length of conveyor surface.

DESCRIPTION OF PREFERRED EMBODIMENTS

Figure 3:
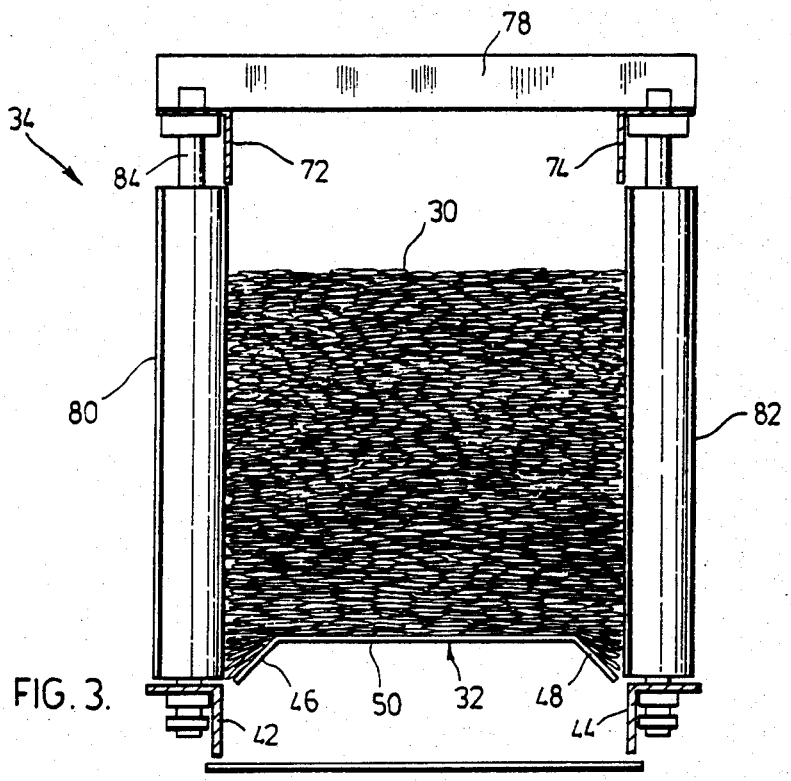
FIG. 3 is a sectional view of the conveyor of FIG. 2, taken on line 3—3 of FIG. 2.
Figure 1:
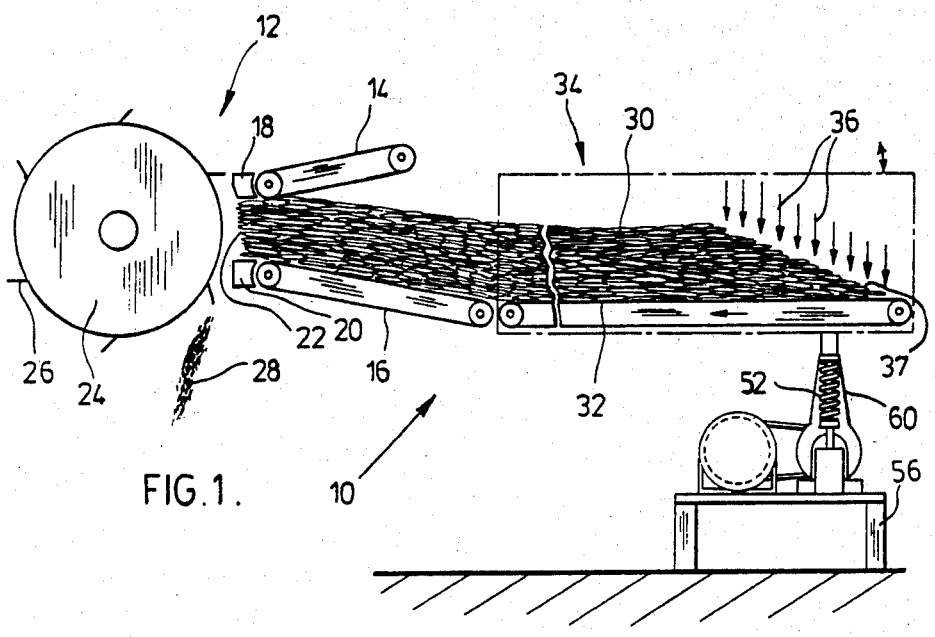
FIG. 1 is an overall schematic representation of one embodiment of apparatus provided in accordance with this invention.

Referring to the drawings, which illustrate the current best mode known to the applicant for effecting the invention, a tobacco cutting apparatus 10 comprises a cutting station 12 wherein upper and lower conveyors 14 and 16 converge towards a downstream throat at which is located a pair of upper and lower pressure plates 18 and 20 mounted to apply pressure to a compacted tobacco mass 22 located therebetween. A rotating drum carrier 24 has a plurality of cutting knives 26 peripherally mounted for cutting shreds of tobacco 28 from the cake 22.

Figure 2:
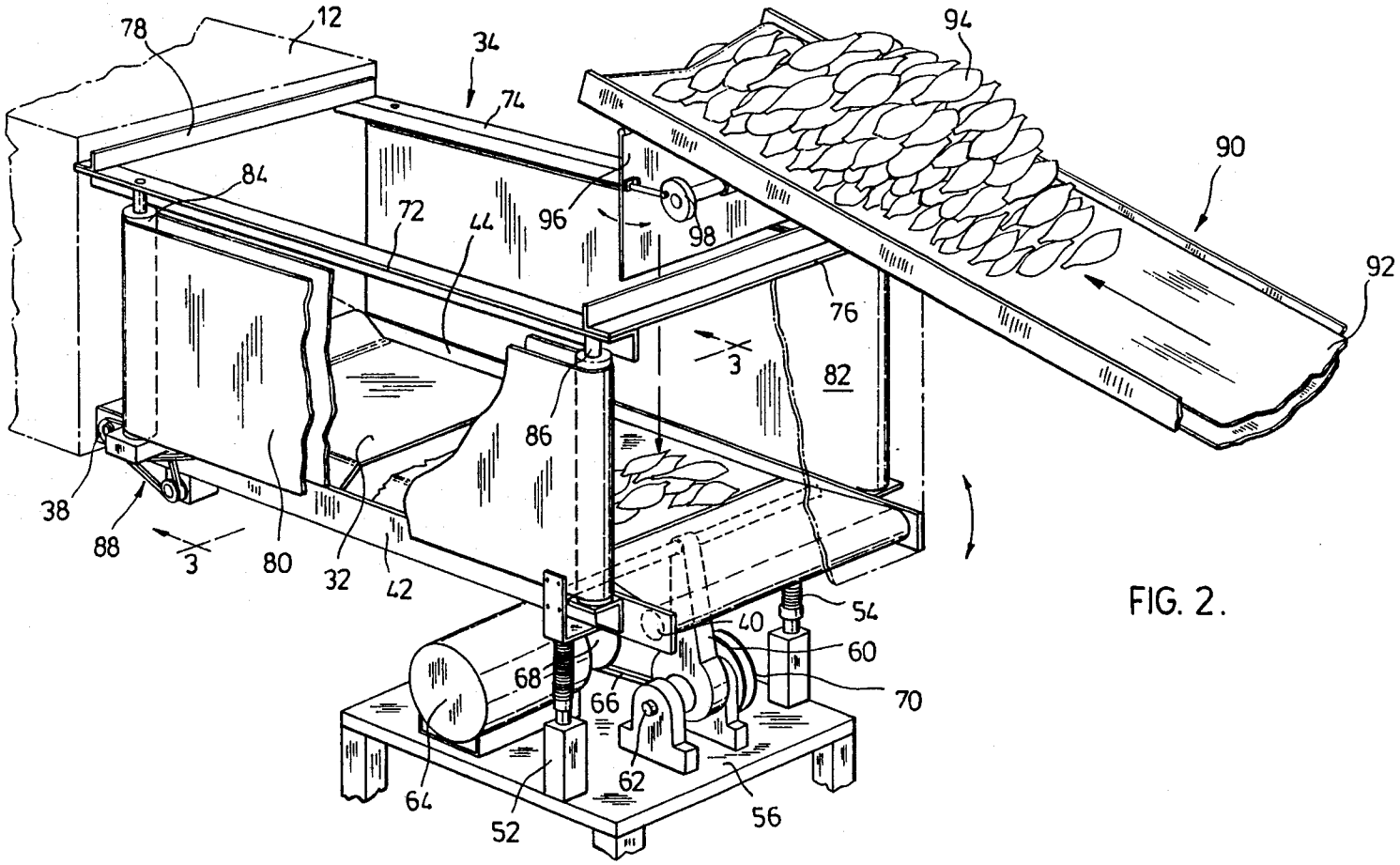
FIG. 2 is a perspective view of an apparatus for feeding tobacco to a cutting machine, constructed in accordance with one embodiment of the invention.

A thick layer 30 of tobacco, which may be in whole leaf or threshed lamina form, is formed on the vibrating conveying surface 32 of a tobacco conveyor 34 from a uniform shower 36 of tobacco which is distributed over a length of the conveying surface 32 at the upstream end thereof, remote from the cutting station 12, and substantially uniformly across the width. The details of construction of the tobacco conveyor 34 are shown in FIGS. 2 and 3.

By distributing the tobacco from the shower 36 over a length of the conveying surface 32, the tobacco is allowed to build up to the required thickness over that length of the conveying surface 32 with the lamina strips lying substantially horizontally, the thickness corresponding to the feed required by the cutting machine 12 at the desired throughput of tobacco. The tobacco is preferably fed to the shower 36 in such quantity as to provide the upwardly-angled rear face 37 of the tobacco layer 30 approximating but not exceeding the angle of repose of the layer. In this way, the tobacco particles do not fall or tumble rearwardly and alter their orientation and juxtaposition.

The vertically-reciprocating vibrations of the conveying surface 32 cause the tobacco to nest and compact while retaining their juxtaposition one to another and their orientation. The vibrational forces of the conveyor 32 and the force of gravity are the only forces applied to the tobacco which cause compaction. Since the conveyor 32 is pivoted at its downstream end, as discussed in more detail below, the magnitude of the vibrations diminish uniformly from the maximum value at the upstream end to zero and the downstream end. In this way, the vibrations diminish as the tobacco layer assumes its compacted form.

The moving surface 32 conveys the thick layer 30 of tobacco to the mouth of the conveyors 14 and 16, whereat the thick layer 30 is transferred to the lower conveyor 16. The layer 30 is conveyed at a constant speed all the way from its formation at the upstream end of the conveying surface 32 to the throat between the downstream end of the conveyors 14 and 16. In this way, the initial horizontal orientation of the tobacco lamina and juxtaposition thereof within the thick layer 30 is maintained to the cutting of the tobacco mass 22. The speed of movement of the thick layer 30 is determined by the conveying speed of the converging conveyors 14 and 16. To ensure that the tobacco in the thick layer 30 retains its orientation and juxtaposition, the surface 30 is preferably run at a conveying speed which is slightly greater than that of the converging conveyors 14 and 16 to cause slipping between the surface 32 and the layer 30.

This procedure enables the pressure that needs to be applied to the cake 22 to prevent lamina pull out to be significantly decreased for the same throughput of tobacco, as compared with the conventional process. Typically, the air cylinder pressure which needs to be applied can be decreased from about 40 psi to about 5 psi. An improved filling power of the tobacco shreds 28 resulting from the cutting has been observed.

Turning now to consideration of FIGS. 2 and 3, details of the construction of the conveyor 34 are illustrated therein. The conveyor 34 has a continuous conveyor belt 32 which is mounted about horizontally-extending rollers 38 and 40 which are mounted to side frame members 42 and 44. The frame members 42 and 44 are pivoted at the downstream end of the conveyor 34 to fixed frame members of cutting station 12.

The conveyor belt 32 is shaped over support members (not shown) to have, when viewed in cross section, downwardly sloping portions 46 and 48 extending at each side of a central planar portion 50. This construction is most clearly seen in FIG. 3. The shaping of the conveyor belt 32 provides a more even distribution of tobacco across the width of the compacted mass 22 than is the case in the prior art.

The frame members 42 and 44 are supported at the end remote from the pivot by compression spring supports 52 and 54 respectively, which are mounted to a support table 56. A cross brace frame member 58 extends between and is affixed the frame members 42 and 44. A crank arm 60 is pivotally connected to the cross-brace frame member 58 and is mounted to an axle 62 to be eccentrically rotated with respect to the axle 62. The axle 62 is driven by motor 64 through belt 66 trained around pulleys 68 and 70.

As the motor 64 drives the axle 62, the crank arm 60 moves eccentricly about the axle 62, thereby raising and lowering the frame members 42 and 44 and hence the conveyor belt 32. The springs 54 cushion the vibrations induced by the movement of the crank arm 60. The motor 64 is run at such a speed as to subject tobacco layer 30 on the surface of the conveyor belt 32 to continuous vibrations of uniformly-diminishing magnitude as the layer 30 is transported by the conveyor belt 32.

Spaced from and joined to the lower frame members 42 and 44 are upper frame members 72 and 74 joined by cross members 76 and 78. Conveyor belts 80 and 82 are mounted between the respective pairs of frame members 42 and 72 and 44 and 74 on rollers 84 and 86, only the two for the conveyor belt 80 being shown.

The conveyors 80 and 82 engage the sides of the tobacco layer 30 and are driven at the same speed as the conveyor belt 32 through a suitable drive mechanism shown schematically at 88. The provision of the moving side belts 80 and 82 engaging the tobacco layer 30 ensures that the tobacco lamina in the layer 30 maintain their orientation and relative juxtaposition and have no tendency to hang-up on stationary confining walls of the conveyor, which may lead to disruption of the tobacco layer and loss of orientation and juxtaposition.

A tobacco feed mechanism 90 is provided to form the tobacco shower 36 containing a uniform distribution of tobacco both transversely and longitudinally of the conveyor 34. The tobacco feed mechanism 90 comprises a feed belt 92 on which threshed tobacco lamina or tobacco leaves 94 are transported to a location above the upstream end of the conveyor belt 32. A plate 96 is hingedly attached adjacent the downstream end of conveyor belt 92 for to-and-fro movement under the influence of drive mechanism 98. The plate 96 engages the tobacco lamina 94 as it falls from the end of the conveyor 92 and its to-and-fro movement causes the shower 36 of tobacco to be formed.

Although the feed belt 92 is illustrated as extending coaxially with the conveyor 34, the same result can be achieved by arranging the feed belt 92 perpendicularly to the conveyor 34, so that the tobacco 94 is fed from the side to the conveyor 34.

The tobacco conveyor 34, therefore, enables a tobacco layer 30 to be formed and transported to the cutting mechanism 14. The tobacco in the layer 30 is oriented substantially planarly, is densified as it is transported by the belts 32, 80 and 82 and maintains its orientation and juxtaposition as it is transported.

SUMMARY OF DISCLOSURE

In summary of this disclosure, the present invention provides an improved procedure for forming and transporting a tobacco layer to a cutting machine. Modifications are possible within the scope of this invention.

What we claim is:

1. In a method of forming cut tobacco shreds by forming a layer of tobacco in whole leaf or threshed lamina form on a conveying surface, the tobacco in said layer being oriented substantially planarly of the layer, being interleaved and being substantially uniformly distributed across the layer; densifying the tobacco layer by applying gravitational and vibrational forces only thereto while simultaneously conveying said tobacco towards the downstream end of said conveying surface without substantially altering the orientation and juxtaposition of the tobacco in said layer; feeding the densified layer onto the lower one of a pair of upper and lower converging conveying surfaces without substantially altering the orientation and juxtaposition of the tobacco in said densified layer; compacting the fed tobacco layer between the converging upper and lower conveying surfaces while conveying the same towards the downstream end of said upper and lower converging conveying surfaces; and cutting tobacco shreds from the forward end of the compacted tobacco layer at the downstream end of the converging conveying surfaces, the improvement which coprises:

confining said tobacco layer on the conveying surface at the sides thereof by confining surfaces, and moving said confining surfaces in the direction of movement of said tobacco layer.

2. The method of claim 1 wherein said conveying surface extends substantially horizontally to the upstream end of said converging conveying surfaces and said layer is formed at the upstream end of said conveying surface.

3. The method of claim 2 wherein said formation of said layer at the upstream end of said conveying surface is effected by showering tobacco downwardly towards said upstream end of said conveying surface and deflecting tobacco in said shower to fall uniformly over a length of said conveying surface whereby said layer is built up over said length of conveying surface.

4. The method of claim 1, 2 or 3 wherein said tobacco is gripped at said downstream end of said converging conveying surfaces during said cutting of tobacco shreds from said forward end of said compacted tobacco layer.

5. The method of claim 1, 2 or 3 wherein the speed of movement of said upper and lower converging conveying surfaces determines the speed of said layer all the way from formation thereof on the conveying surface to the downstream end of the upper and lower converging conveying surfaces and the confining surfaces and conveying surface move at a slightly greater conveying speed than that of said converging conveying surfaces to ensure that said orientation and juxtaposition of tobacco in said layer is maintained all the way from formation of said layer to the downstream end of the converging conveyors.

6. A method of forming cut tobacco shreds, which comprises:

forming a layer of tobacco in whole leaf or threshed lamina form on a substantially horizontal conveying surface adjacent the upstream end thereof, the tobacco in said layer being oriented substantially planarly of the layer, being interleaved and being substantially uniformly distributed across the layer;

densifying the tobacco layer by applying gravitational and vibrational forces only thereto while simultaneously conveying said tobacco layer on said conveying surface towards the downstream end thereof without substantially altering the orientation and juxtaposition of the tobacco in said layer, said vibrational forces decreasing in a uniform manner from a maximum value at the upstream end of said conveying surface to a minimum value at the downstream end of said conveying surface;

feeding the densified layer onto the lower one of a pair of upper and lower converging conveying surfaces without substantially altering said orientation and juxtaposition of the tobacco in said densified layer;

compacting the fed tobacco layer between the converging upper and lower conveying surfaces while conveying the same towards the downstream end of said upper and lower converging conveying surfaces; and cutting tobacco shreds from the forward end of the compacted tobacco layer at the downstream end of the converging conveyors.

7. The method of claim 6 wherein said formation of said layer of tobacco is effected by showering tobacco downwardly towards said upstream end of said conveying surface, distributing the shower of the tobacco uniformly over a length of the conveying surface, whereby the combined effect of the uniform showering of the tobacco and the rectilinear conveying of the layer produces a tobacco layer having an upwardly-inclined rear surface extending in the direction of movement of the layer, and feeding tobacco to said shower in sufficient quantity such that the angle of said upwardly-inclined rear surface approximates but does not exceed the angle of repose of the layer, whereby said showered and distributed tobacco lie planarly in said layer and do not fall or tumble from the rear surface of said layer.

8. The method of claim 6 wherein said conveying surface is mounted for pivoting about a horizontally-extending pivot located at its downstream end, whereby said vibrational forces are zero at said downstream end.

9. A method of forming cut tobacco shreds, which comprises:

showering tobacco in whole leaf or threshed lamina form downwardly towards the upstream end of a substantially horizontal conveying surface;

distributing the shower of tobacco uniformly over a length of the conveying surface while said conveying surface moves towards the downstream end thereof to form a layer of tobacco on said conveying surface wherein the tobacco is oriented substantially planarly of the layer, is interleaved and is substantially uniformly distributed across the layer and which has an upwardly-inclined rear surface extending in the direction of movement of the layer;

feeding tobacco to said shower in sufficient quantity such that the angle of said upwardly-inclined rear surface approximates but does not exceed the angle of repose of the layer, whereby said showered and distributed tobacco lie planarly in said layer and do not tumble or fall from the rear surface of said layer;

densifying the tobacco layer by applying gravitational and vibrational forces only thereto while simultaneously conveying said tobacco layer on said conveying surface towards the downstream end thereof without substantially altering the orientation and juxtaposition of the tobacco in said layer;

feeding the densified layer onto the lower one of a pair of upper and lower converging conveying surfaces without substantially altering said orientation and juxtaposition of the tobacco in said densified layer;

compacting the fed tobacco layer between the converging upper and lower conveying surfaces while conveying the same towards the downstream end of said upper and lower converging conveying surfaces; and cutting tobacco shreds from the forward end of the compacted tobacco layer at the downstream end of the converging conveyors.

10. The method of claim 6, 7, 8 or 9, including:

confining said tobacco layer at the sides thereof by confining surfaces, and moving said confining surfaces substantially at the speed of and in the direction of movement of said conveying surface.

11. The method of claim 10, wherein said confining surfaces and said conveying surface move at a speed which is slightly greater than the speed of said converging conveyors.

12. The method of claim 6, 7, 8 or 9, wherein said compacted tobacco layer is gripped at said downstream end of said converging conveying surfaces during said cutting of said tobacco shreds from said forward end of said compacted tobacco layer.

* * * * *